US009114274B2

(12) United States Patent
Kwon et al.

(10) Patent No.: US 9,114,274 B2
(45) Date of Patent: Aug. 25, 2015

(54) SYSTEM FOR DYNAMICALLY TRAINING POSTURAL BALANCE

(75) Inventors: Dae Kyu Kwon, Jeonju-si (KR); Jung Pyo Hong, Jeonju-si (KR); Jong Dae Kwon, Jeonju-si (KR); Mi Yu, Wanju-gun (KR); Gu Young Jeong, Jeonju-si (KR); Kyong Kim, Jeonju-si (KR)

(73) Assignee: INDUSTRIAL COOPERATION FOUNDATION CHONBUK NATIONAL UNIVERSITY, Jeonju-Si (KR)

( * ) Notice: Subject to any disclaimer, the term of this patent is extended or adjusted under 35 U.S.C. 154(b) by 262 days.

(21) Appl. No.: 13/879,744

(22) PCT Filed: Jun. 30, 2011

(86) PCT No.: PCT/KR2011/004795

§ 371 (c)(1),
(2), (4) Date: Apr. 16, 2013

(87) PCT Pub. No.: WO2012/053726

PCT Pub. Date: Apr. 26, 2012

(65) Prior Publication Data

US 2013/0203571 A1 Aug. 8, 2013

(30) Foreign Application Priority Data

Oct. 22, 2010 (KR) ..... 10-2010-0103394

(51) Int. Cl.

| | |
|---|---|
| ***A63B 26/00*** | (2006.01) |
| ***A61H 1/02*** | (2006.01) |
| ***A63B 21/00*** | (2006.01) |
| ***A63B 22/16*** | (2006.01) |
| ***A63B 22/18*** | (2006.01) |
| ***A63B 24/00*** | (2006.01) |
| ***A63B 71/06*** | (2006.01) |

(52) U.S. Cl.

CPC ..... *A63B 26/003* (2013.01); *A61H 1/0237* (2013.01); *A61H 1/0292* (2013.01);

(Continued)

(58) Field of Classification Search

CPC ..... A61H 2201/0103; A61H 2203/0406; A63B 21/1419; A63B 22/14; A63B 22/16; A63B 22/18; A63B 26/003

USPC ..... 482/51, 66–69, 78–80, 142, 145–147; 601/23, 27–32; 472/118–121, 124, 135

See application file for complete search history.

(56) References Cited

U.S. PATENT DOCUMENTS 3,936,047 A * 2/1976 Brandt et al. ..... 482/146
4,199,137 A 4/1980 Giguere (Continued)

FOREIGN PATENT DOCUMENTS

KR 10-1995-0010496 B1 12/1993
KR 10-0863494 B1 10/2008

(Continued)

*Primary Examiner* — Stephen Crow
*Assistant Examiner* — Gregory Winter
(74) *Attorney, Agent, or Firm* — Novick, Kim & Lee, PLLC; Jae Youn Kim

(57) ABSTRACT

A dynamic postural balance training system includes a base frame, a support frame which extends upwards from the base frame, a roll motion frame which is coupled to the upper portion of the support frame by a first shaft so as to be rotatable to the left or the right, and a pitch motion frame which is coupled to the roll motion frame by a second shaft so as to be rotatable forwards or rearwards. The system also includes a pelvis fastening unit which is disposed inside the pitch motion frame and which expands to fix the pelvis of the user in place, a connector which extends downwards from the pitch motion frame, and a foot fastening unit which is coupled to the lower end of the connector and expands to fix the feet of the user in place.

11 Claims, 15 Drawing Sheets

(52) U.S. Cl.
CPC ..... *A63B21/143* (2013.01); *A63B 21/1419* (2013.01); *A63B 21/1465* (2013.01); *A63B 22/16* (2013.01); *A63B 22/18* (2013.01); *A63B 24/0087* (2013.01); *A63B 71/0619* (2013.01); *A63B 71/0622* (2013.01); *A61H 2201/0103* (2013.01); *A61H 2201/163* (2013.01); *A61H 2201/1642* (2013.01); *A61H 2201/5007* (2013.01); *A61H 2203/0406* (2013.01); *A63B 2022/185* (2013.01)

(56) References Cited

U.S. PATENT DOCUMENTS

| | | | | | |
|---|---|---|---|---|---|
| 5,449,335 | A * | 9/1995 | Steinfeld | ..... | 482/110 |
| 5,941,807 | A * | 8/1999 | Cassidy et al. | ..... | 482/146 |
| 6,110,048 | A * | 8/2000 | Murray | ..... | 472/16 |
| 6,368,296 | B1 * | 4/2002 | Eiter et al. | ..... | 602/19 |
| 6,740,011 | B1 * | 5/2004 | Tsai et al. | ..... | 482/80 |
| 6,758,792 | B1 * | 7/2004 | Chang | ..... | 482/54 |
| 6,918,856 | B2 * | 7/2005 | Chang | ..... | 482/51 |
| 7,086,996 | B2 * | 8/2006 | Matjacic et al. | ..... | 482/69 |
| 7,446,116 | B2 * | 11/2008 | Bartl et al. | ..... | 514/311 |
| 7,465,253 | B2 * | 12/2008 | Perry et al. | ..... | 482/51 |
| 2009/0124472 | A1 * | 5/2009 | Chou | ..... | 482/142 |
| 2011/0212814 | A1 * | 9/2011 | Gehris, Jr. | ..... | 482/142 |
| 2013/0005547 | A1 * | 1/2013 | Wang | ..... | 482/142 |
| 2014/0287846 | A1 * | 9/2014 | Mountz et al. | ..... | 472/118 |

FOREIGN PATENT DOCUMENTS

| | | | |
|---|---|---|---|
| KR | 20-0442959 | Y1 | 12/2008 |
| KR | 10-2010-0026527 | A | 10/2011 |

* cited by examiner

SYSTEM FOR DYNAMICALLY TRAINING POSTURAL BALANCE

CROSS REFERENCES RELATED APPLICATIONS

The present application claims priority under 35 U.S.C. 119 and 35 U.S.C. 365 to Korean Patent Application No. 10-2010-0103394 (filed on Oct. 22, 2010) and International application No. PCT/KR2011/004795 (filed on June 30) thereof, which are hereby incorporated by reference in its entirety.

TECHNICAL FIELD

The present invention relates to a dynamic postural balance training system which enables a user to conduct a postural balance exercise and a remedial exercise.

BACKGROUND ART

Generally, dynamic postural balance training systems which enable a user to conduct dynamic postural balance training are used for the old and the infirm, that is, those who are not able to move about freely, or hemiplegic patients who have a problem in keeping the balance between the left-side and right-side muscles. The user can do postural balance exercises or remedial exercises using such a dynamic postural balance training system.

A representative example of dynamic postural balance training systems was proposed in Korean Patent Application No. 10-2010-0026527, which was filed by the applicant of the present invention. This conventional dynamic postural balance training system includes a base frame; a support frame which extends upwards from the base frame; a roll motion frame which is coupled to an upper end of the support frame by a first shaft so as to be rotatable to the left or the right; a pitch motion frame which is coupled to the roll motion frame by a second shaft so as to be rotatable forwards or rearwards; a connector which extends downwards from the pitch motion frame; and a footrest unit which is provided on a lower end of the connector.

However, in Korean Patent Application No. 10-2010-0026527 filed by the applicant of the present invention, a monitor that enables a user to monitor information about exercise conditions when the user is conducting dynamic postural balance training is not provided. Furthermore, although other conventional dynamic postural balance training systems provided with monitors were introduced, they are configured such that a monitor is fixed to a frame. Hence, if a user who has been rotated to the left or right looks at the monitor, he or she will see it as if it is tilted at a predetermined angle, thus making it inconvenient for the user to monitor exercise condition information displayed on the monitor.

Furthermore, the conventional dynamic postural balance training systems are problematic in that depending on the body type of a user, in other words, the size or shape of the pelvis and feet of the user, it may be difficult to stably fix the pelvis and feet of the user. Moreover, when the pelvis and feet of the user are fixed for a long time, the user may feel pressure and discomfort.

DISCLOSURE

Technical Problem

Accordingly, the present invention has been made keeping in mind the above problems occurring in the prior art, and an object of the present invention is to provide a dynamic postural balance training system which can fix a user in one place such that the user can feel comfortable, and which makes it possible for the user to more easily exercise, thus enhancing the efficiency of the dynamic postural balance training.

Technical Solution

In order to accomplish the above object, the present invention provides a dynamic postural balance training system, including: a base frame; a support frame extending upwards from the base frame; a roll motion frame coupled to an upper end of the support frame by a first shaft so as to be rotatable in a left-right direction; a pitch motion frame coupled to the roll motion frame by a second shaft so as to be rotatable in a front-rear direction; a pelvis fastening unit provided inside the pitch motion frame, the pelvis fastening unit being expanded in volume to support a pelvis of a user; a connector extending downwards from the pitch motion frame; and a foot fastening unit coupled to a lower end of the connector, the foot fastening unit being expanded in volume to support feet of the user.

The connector may include: a support pipe coupled to a lower portion of each of opposite ends of the pitch motion frame; a movable pipe slidably disposed in the support pipe, with a plurality length adjustment holes formed in an outer surface of the movable pipe at positions spaced apart from each other in a longitudinal direction of the movable pipe; and a bolt inserted into a lower portion of the support pipe and coupled to one selected from among the length adjustment holes, whereby a height of the foot fastening unit can be adjusted.

The pelvis fastening unit may include: a pelvis fixing air cushion provided on a circumferential inner surface of each of front and rear parts of the pitch motion frame, the pelvis fixing air cushion being expanded in volume by compressed air supplied thereinto; and an air supply hose connected to the pelvis fixing air cushion so that compressed air is transmitted from a compressor into the pelvis fixing air cushion through the air supply hose, wherein a memory foam made of latex is provided on a circumferential outer surface of the pelvis fixing air cushion, the memory foam being brought into close contact with the pelvis of the user when the pelvis fixing air cushion is expanded.

The foot fastening unit may include: a footrest support body coupled to the lower end of the connector, the footrest support body having a planar shape; a footrest provided on an upper surface of the footrest support body, the footrest comprising a pair of footrests to receive the feet of the user; and a foot support air cushion provided on an inner surface of each of the footrests, the foot support air cushion being expanded in volume by compressed air supplied thereinto, thus supporting the corresponding foot of the user.

Each of the pair of footrests may include: a bottom part installed on the footrest support body so that a sole of the corresponding foot of the user is placed on the bottom part; a heel support part extending upwards from a rear end of the bottom part; and a foot strap part extending upwards from a front end of the bottom part, the foot strap part having a loop shape to wrap a top of the foot of the user, and the foot support air cushion may include: a first foot support air cushion provided on an inner surface of each of the bottom part and the heel support part; and a second foot support air cushion provided on an inner surface of the foot strap part, and wherein a memory foam is provided on each of the first and second foot support air cushions, the memory foam being made of latex material.

The dynamic postural balance training system may further include a monitor provided on an upper end of a monitor support extending upwards from a medial portion of a circumferential outer surface of the roll motion frame, the monitor being rotated in conjunction with the roll motion frame.

Advantageous Effects

In the present invention, a monitor can be rotated in response to rotation of the body of a user. Therefore, the user can more easily use the monitor to monitor his/her exercise conditions, whereby the exercise efficiency can be improved.

Furthermore, in the present invention, a foot support air cushion is used to fix the feet of the user in one place. Even after a long time has passed, the user can comfortably perform the remedial exercise. Moreover, because an outer surface of the foot support air cushion is made of soft memory foam material, the foot support air cushion can reliably wrap and support the foot of the user regardless of the size or shape of the foot. Therefore, the user can more comfortably carry out dynamic postural balance training.

In addition, a pelvis fixing air cushion is expanded by compressed air supplied thereinto and is changed in shape corresponding to the pelvis of the user so that it can be brought into close contact with the pelvis of the user. Therefore, the pelvis of the user can be comfortably supported by the pelvis fixing air cushion regardless of the size and shape of the pelvis of the user, whereby the efficiency of the remedial exercise can be enhanced.

BEST MODE

Hereinafter, a dynamic postural balance training system according to an embodiment of the present invention will be described in detail with reference to the attached drawings.

Figure 1:
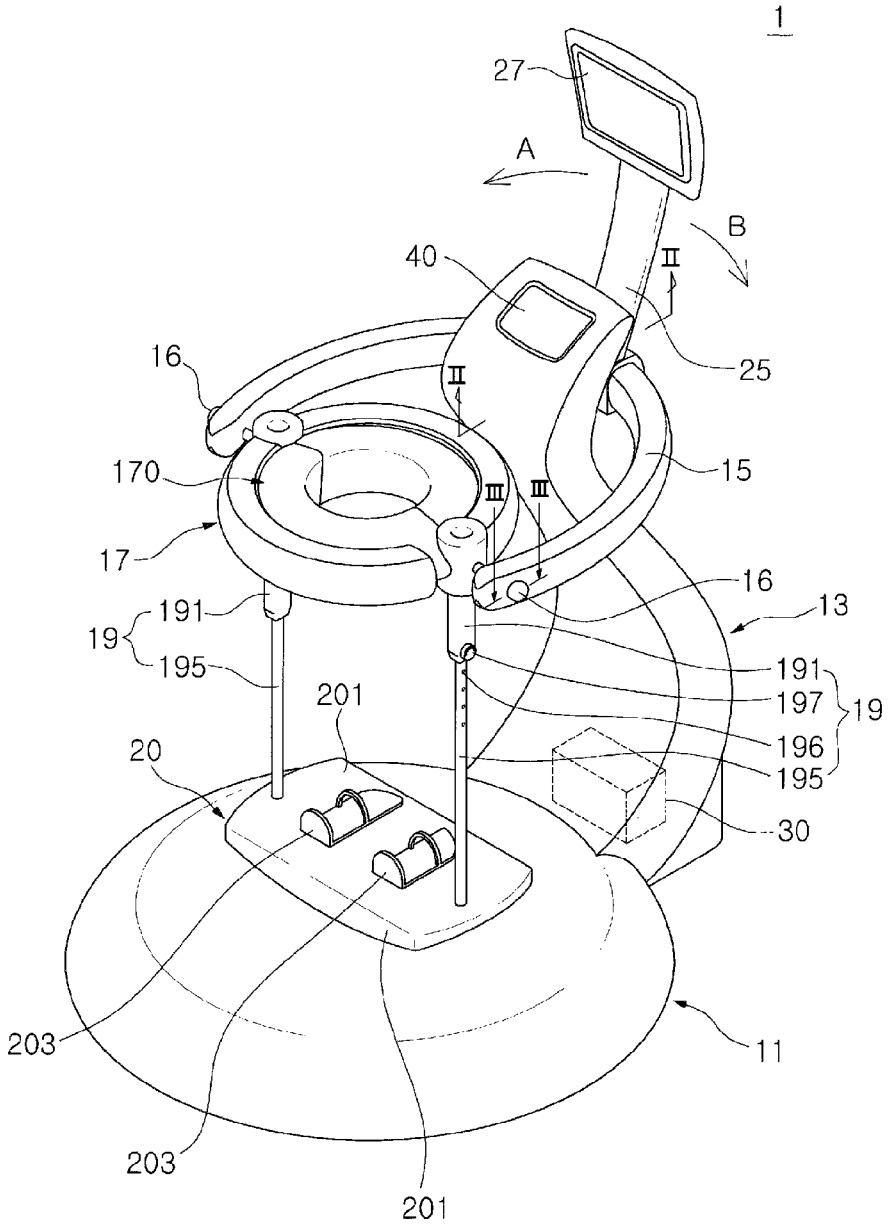
FIG. 1 is a perspective view illustrating a dynamic postural balance training system, according to an embodiment of the present invention.
Figure 2:
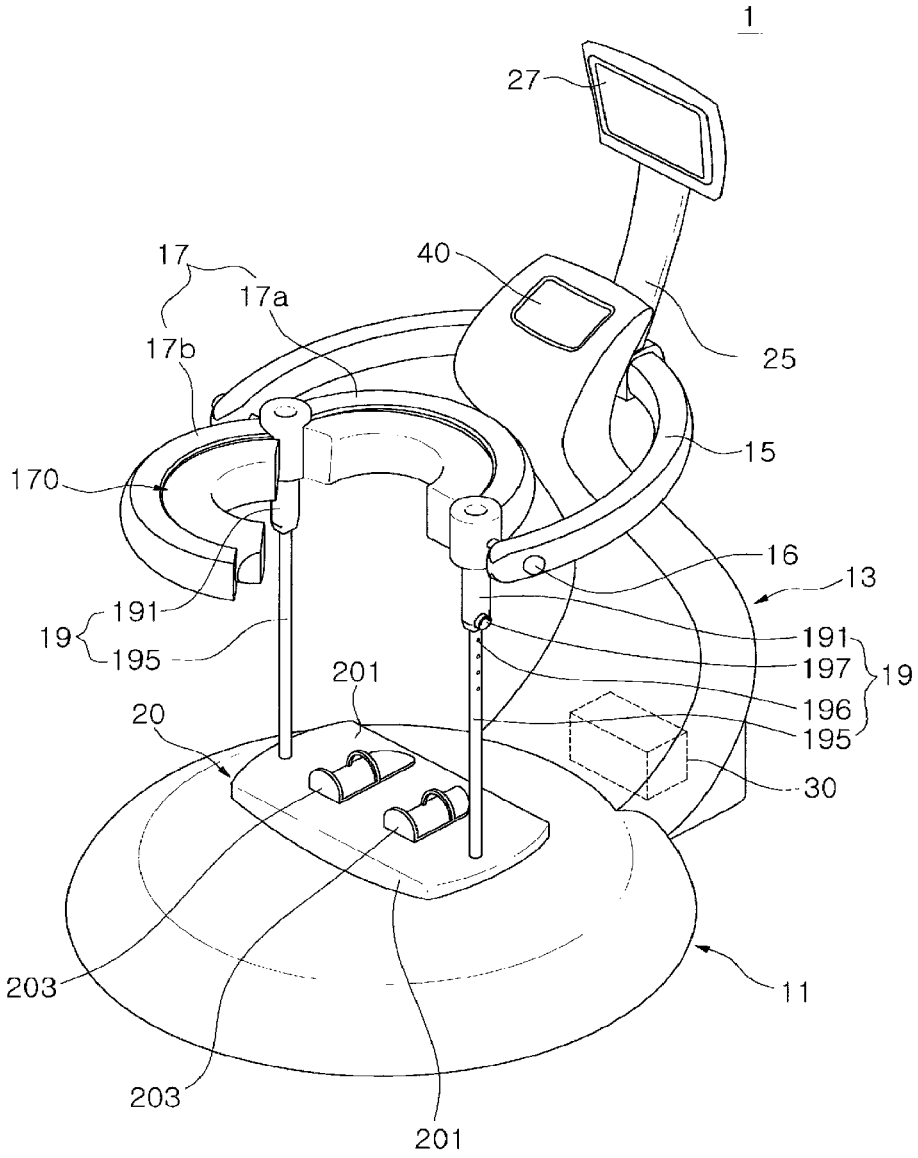
FIG. 2 is a perspective view illustrating a pitch motion frame, one side of which is open so that the pelvis of a user can be located in the pitch motion frame of FIG. 1 through the opening of the pitch motion frame.
Figure 3:
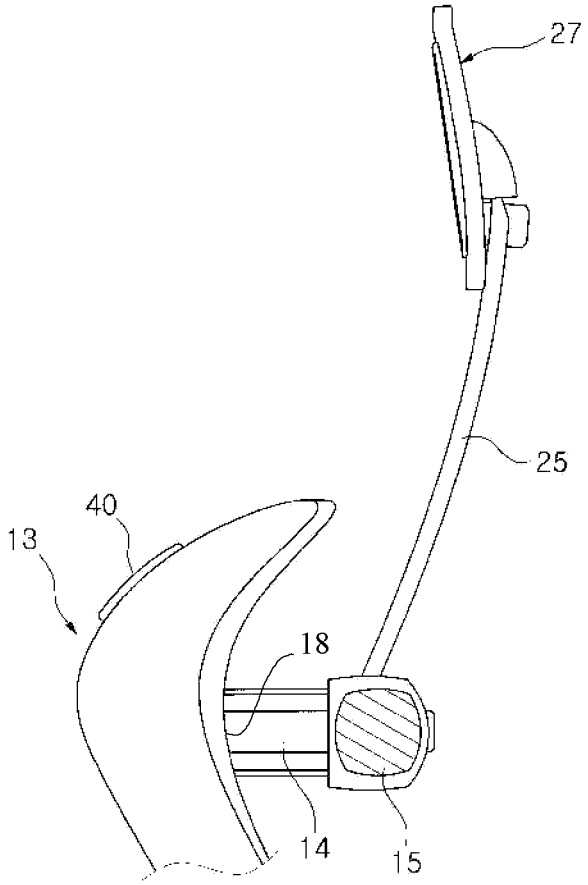
FIG. 3 is a sectional view taken along line II-II of FIG. 1.

Referring to FIGS. 1 through 3, the dynamic postural balance training system 1 includes a base frame 11, a support frame 13, a roll motion frame 15, a pitch motion frame 17, a pelvis fastening unit 170, a connector 19, a foot fastening unit 20 and a monitor 27.

The base frame 11 is horizontally placed on and fixed to the ground. In this embodiment, although the base frame 11 has been illustrated as having a circular shape with consideration for an aesthetic appearance, the shape of the base frame 11 may be changed, so long as it can be stably fixed to the ground.

The support frame 13 extends from a rear portion of the base frame 11 upwards.

The roll motion frame 15 is coupled to an upper end of the support frame 13 by a first shaft 14 so as to be rotatable to the left or the right. A front end of the first shaft 14 which is oriented in the front-rear direction is fastened to a rear surface of the upper end of the support frame 13 by a bearing 18. A rear end of the first shaft 14 is fixed to a medial portion of the roll motion frame 15 by welding.

The pitch motion frame 17 is coupled to an inner surface of the roll motion frame 15 by a pair of second shafts 16 so as to be rotatable in the front-rear direction.

The pitch motion frame 17 provides space required to receive the pelvis of the user. To allow the user to be located in the pitch motion frame 17, as shown in FIG. 2, the pitch motion frame 17 includes a pair of semicircular bodies which forms a loop shape. In this embodiment, the pitch motion frame 17 is configured such that a second pitch motion frame body 17*b* can be rotated with respect to a first pitch motion frame body 17*a* to open a portion of the pitch motion frame 17. In detail, after the second pitch motion frame body 17*b* is rotated such that an end of the second pitch motion frame body 17*b* moves away from a corresponding end of the first pitch motion frame body 17*a*, the user enters a space between the first and second pitch motion frame bodies 17*a* and 17*b*. Thereafter, the second pitch motion frame body 17*b* is closed. As a result, the pelvis of the user is located in the pitch motion frame 17. Although it is not shown in the drawings, a typical fastening member such as a button type hook may be provided on the pitch motion frame 17 to releasably lock the end of the first pitch motion frame body 17*a* to the second pitch motion frame body 17*b*.

Figure 4:
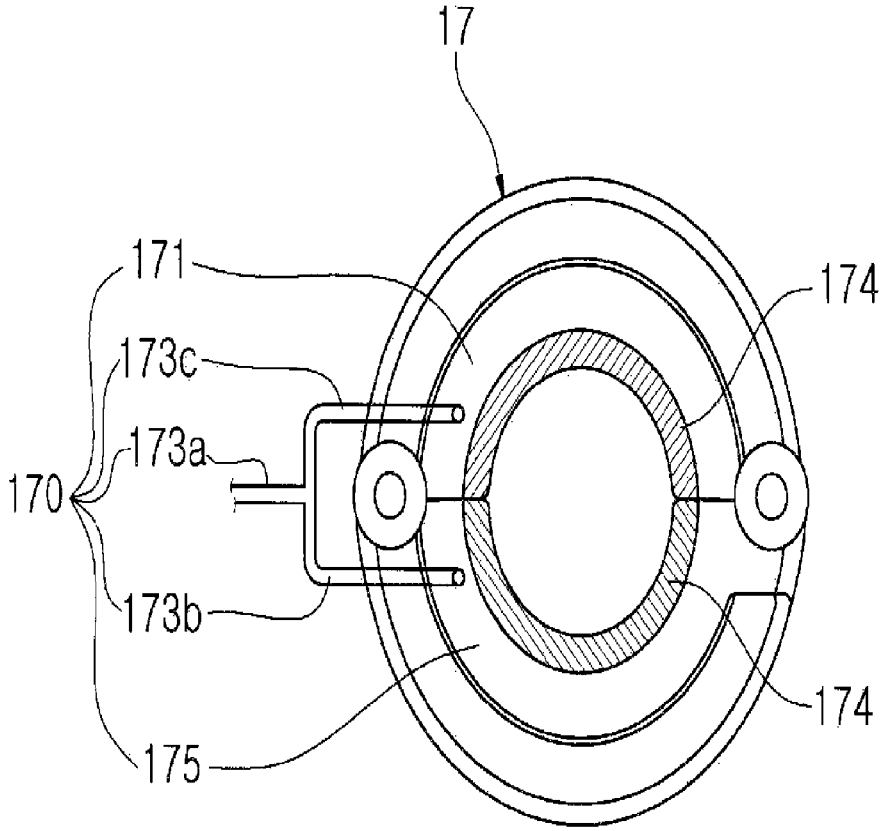
FIG. 4 is a plan view showing the construction of a pelvis fastening unit that is installed in the pitch motion frame of FIG. 1 to support the pelvis of the user.

As shown in FIGS. 1 and 4, the pelvis fastening unit 170 is installed on a circumferential inner surface of the pitch motion frame so as to support the pelvis of the user who is located in the pitch motion frame 17.

The pelvis fastening unit 170 includes pneumatic pelvis fixing air cushions 171 and 175.

Each of the first and second pelvis fixing air cushions 171 and 175 has a semicircular band shape. Portions of circumferential outer surfaces of the first and second pelvis fixing air cushions 171 and 175 are respectively bonded to the circumferential inner surfaces of the first and second pitch motion frame bodies 17*a* and 17*b* of the pitch motion frame 17 by an adhesive or the like. Each of the first and second pelvis fixing air cushions 171 and 175 is made of elastic material such as rubber and can be expanded by high pressure compressed air supplied thereinto. A memory foam 174 is provided on a circumferential inner surface of each of the first and second pelvis fixing air cushions 171 and 175.

Air supply hoses 173*a*, 173*b* and 173*c* are provided to supply high pressure compressed air to the first and second pelvis fixing air cushions 171 and 175.

A first end of the first air supply hose 173*a* is airtightly connected to a high pressure air supply unit (not shown) such as a compressor. A first end of the second air supply hose 173*b* is connected to the first air supply hose 173*a*, and a second end thereof communicates with the first pelvis fixing air cushion 171. A first end of the third air supply hose 173*c* is connected to the first air supply hose 173*a*, and a second end thereof communicates with the second pelvis fixing air cushion 175.

The high pressure air supply unit (not shown) is electrically connected, in a wire or wireless manner, to a control unit 30 which will be explained later herein. The control unit 30 controls the high pressure air supply unit (not shown) according to a manipulation signal of a manipulation unit 40 which will be explained later herein, whereby high pressure air can be supplied into the first and second pelvis fixing air cushions 171 and 175 through the air supply hoses 173*a*, 173*b* and 173*c*.

In this construction, the first and second pelvis fixing air cushions 171 and 175 are expanded in volume by the high pressure compressed air supplied theretino. As a result, the pelvis of the user who is located in the pitch motion frame 17 is brought into close contact with the memory foams 174 so that the pelvis of the user is fixed in one place.

In this case, because the pelvis of the user is supported by the first and second pelvis fixing air cushions 171 and 175 that is expanded by compressed air, the pelvis can be stably supported regardless of the size or shape of the pelvis. Moreover, since the memory foam 174, which comes into close contact with the pelvis of the user to support it, is made of latex material, the memory foam 174 is changed into a shape corresponding to the pelvis of the user when it comes into contact with the pelvis, thus making it possible for the user to perform remedial exercise without inconvenience.

The connector 19 comprises a pair of connectors 19 which extend downwards from the respective opposite ends of the pitch motion frame 17.

Each connector 19 includes a support pipe 191 which is coupled to a lower portion of a corresponding one of the opposite ends of the pitch motion frame 17, and a movable pipe 195 which is slidably disposed in the support pipe 191. A plurality of length adjustment holes 196 are formed in an outer surface of the movable pipe 195 at positions spaced apart from each other in the longitudinal direction at regular intervals so that the length of the connector 19 can be adjusted. A bolt 197 is inserted into a lower portion of the support pipe 191 and is selectively coupled to any one of the length adjustment holes 196.

The foot fastening unit 20 is fixed to lower ends of the movable pipes 195 and configured such that the feet of the user can be supported on the foot fastening unit 20. Depending on the length of the legs of the user, the height of the foot fastening unit 20 can be adjusted by changing the lengths of the connectors 19. Here, the height of the foot fastening unit 20 refers to the distance between an upper surface of the base frame 11 and a footrest support body 201

Figure 5:
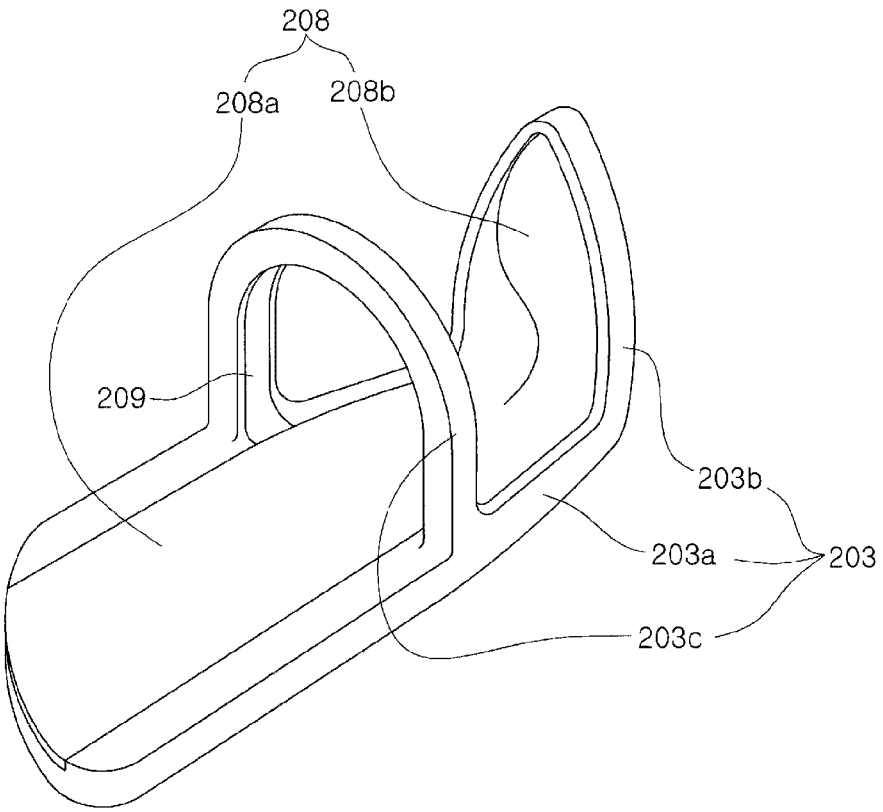
FIG. 5 is an enlarged perspective view illustrating a foot support air cushion installed in a footrest shown in FIG. 1.
Figure 6:
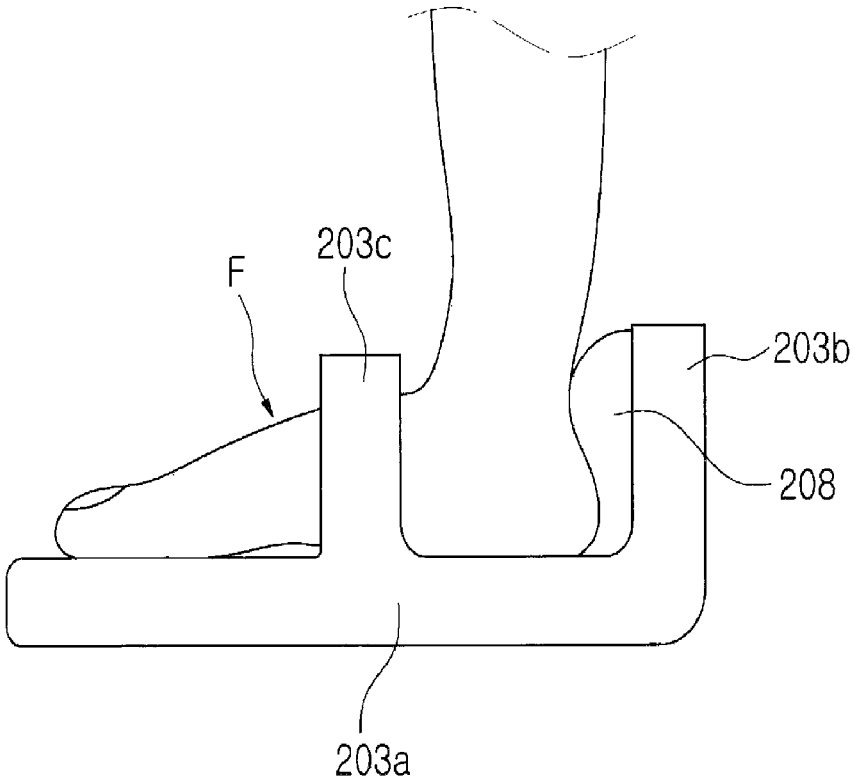
FIG. 6 is an enlarged side view showing the user's foot that has been inserted into the footrest of FIG. 4.
Figure 7:
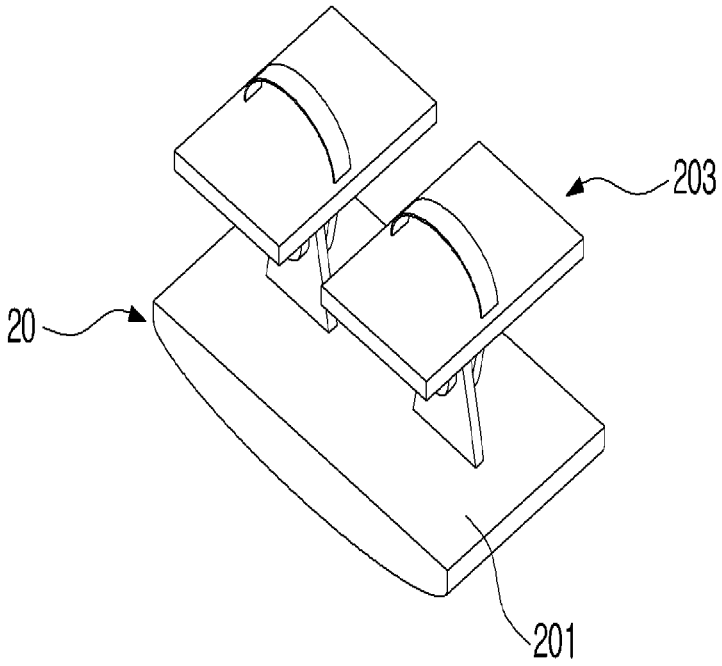
FIG. 7 is a perspective view illustrating another example of the footrest.

Referring to FIGS. 1, 5 and 6, the foot fastening unit 20 includes the footrest support body 201, a footrest 203 and first and second foot support air cushions 208 and 209.

The footrest support body 201 has a planar shape and is disposed in the horizontal direction. Opposite ends of the footrest support body 201 are fixed to the respective movable pipes 195.

The footrest 203 comprises a pair of footrests 203 into which the feet of the user are inserted. The footrests 203 are fixed on an upper surface of the footrest support body 201. Each footrest 203 includes a bottom part 203*a* on which the sole of the user's foot is placed, a heel support part 203*b* which extends upwards from a rear end of the bottom part 203*a*, and a foot strap part 203*c* which extends upwards from a front end of the bottom part 203*a* and has a loop shape to wrap over the top of the foot of the user.

Each of the first and second foot support air cushions 208 and 209 is made of elastic material such as rubber so that it can be expanded by high pressure compressed air supplied thereinto.

The first foot support air cushion 208 is configured in such a way that it covers an inner surface of the bottom part 203*a* and an inner surface of the heel support part 203*b*. The second foot support air cushion 209 is configured in such a way that it covers an inner surface of the foot strap part 203*c*. The first foot support air cushion 208 includes a first part 208*a* which is provided on the bottom part 203*a*, and a second part 208*b* which is provided on the heel support part 203*b* and connected to the first part 208*a*.

The first and second foot support air cushions 208 and 209 are connected to a high pressure air supply unit (not shown) such as an air compressor so that high pressure compressed air can be supplied into the first and second foot support air cushions 208 and 209. A memory foam made of latex material or the like is provided on an outer surface of each of the first and second foot support air cushions 208 and 209, whereby when the foot support air cushions 208 and 209 are expanded, they can smoothly come into close contact with the foot of the user.

In this construction, when compressed air is supplied into the first and second foot support air cushions 208 and 209 and expands them, the user's foot (F, refer to FIG. 6) that is in the footrest 203 can be fixed in one place. In other words, the first and second foot support air cushions 208 and 209 are expanded by the compressed air towards the sole, the heel and the top of the foot, and the memory foams are also expanded and are brought into close contact with the sole, the heel, the top, etc. of the foot, whereby the foot can be fixed in one place.

As such, because the foot of the user is fixed in one place by the first and second foot support air cushions 208 and 209 that are expanded by compressed air, the foot of the user can be stably fixed regardless of the size or shape of the foot. Furthermore, because the memory foams made of soft material can be changed into a shape corresponding to the foot of the user and be brought into close contact with the foot to support it, the foot of the user can be reliably fixed in one place without inconvenience.

Referring to FIGS. 7 through 13, as other examples, the foot fastening unit 20 may include a footrest support body 201, a footrest 203 and a foot support air cushion 210.

The footrest support body 201 has the same structure as that of the above-stated example, therefore further explanation is deemed unnecessary.

Figure 10:
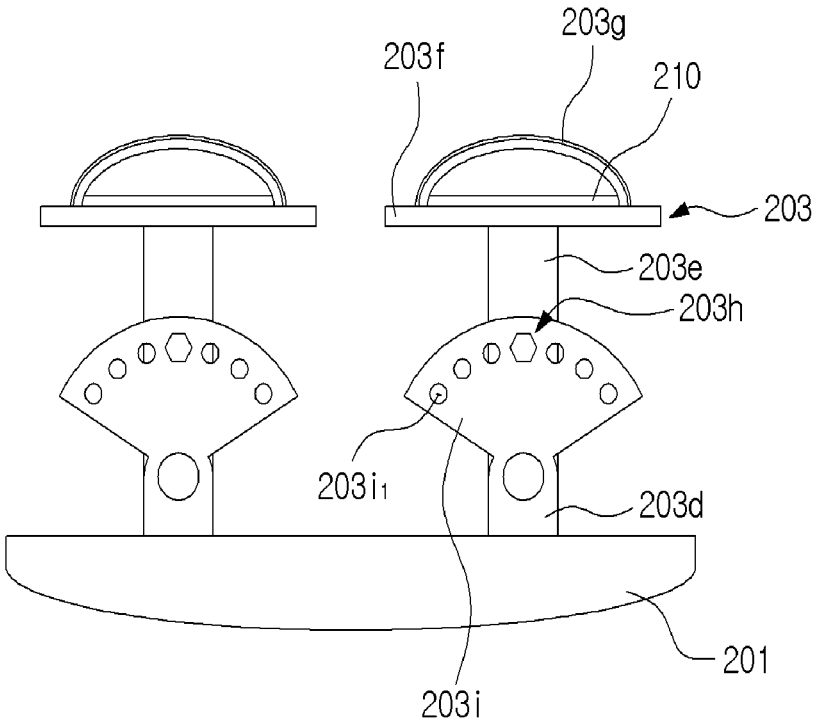
FIGS. 10 and 11 are front views schematically showing another example of the footrest.
Figure 11:
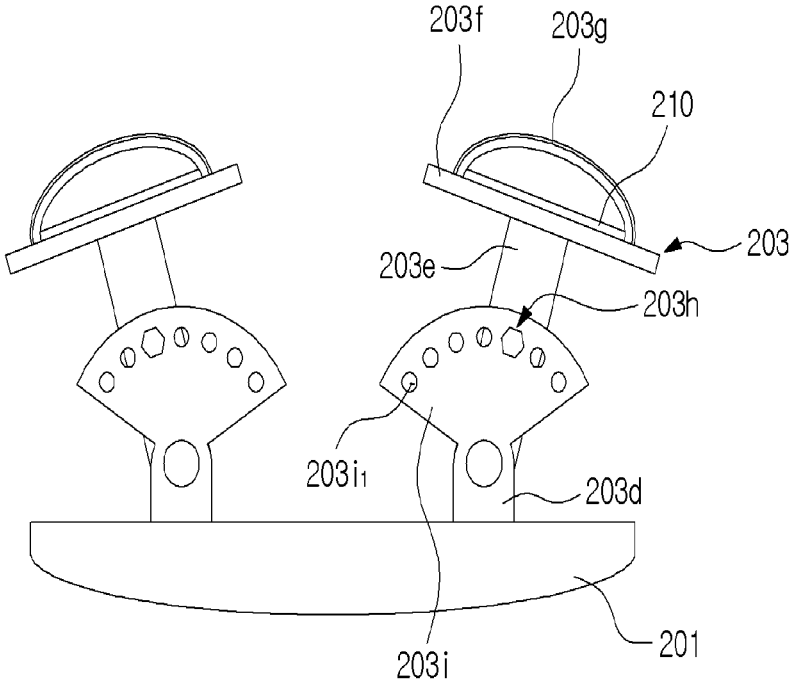
Figure 12:
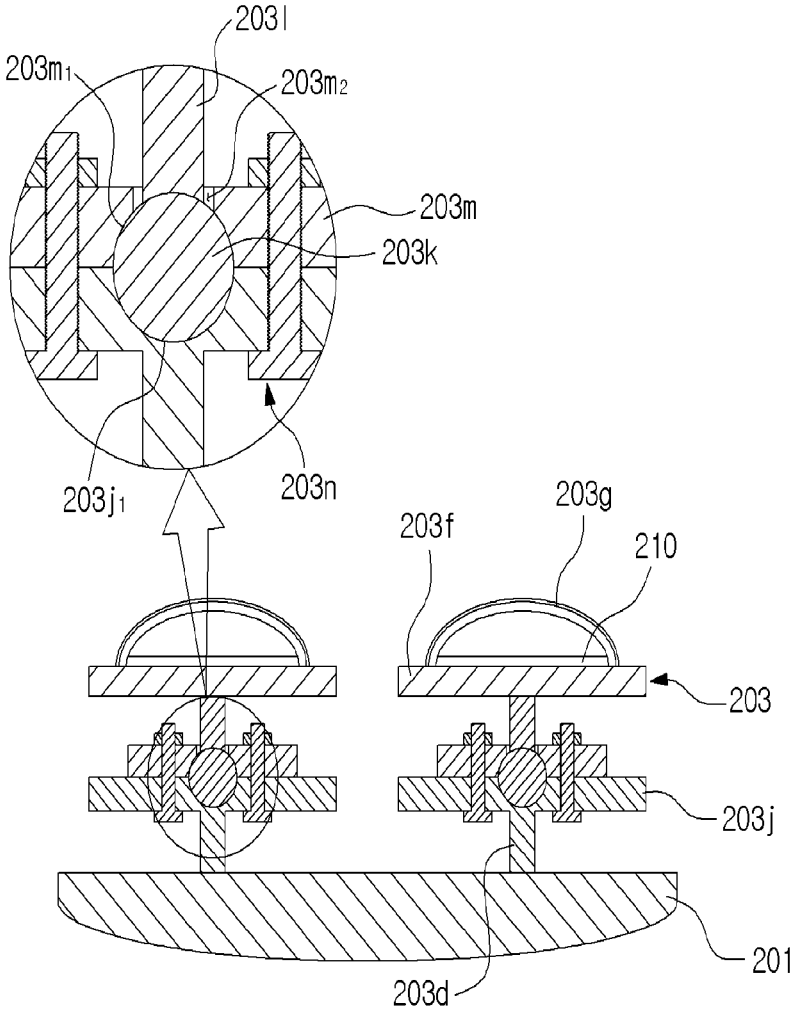
FIGS. 12 and 13 are sectional views schematically showing a further example of the footrest.
Figure 13:
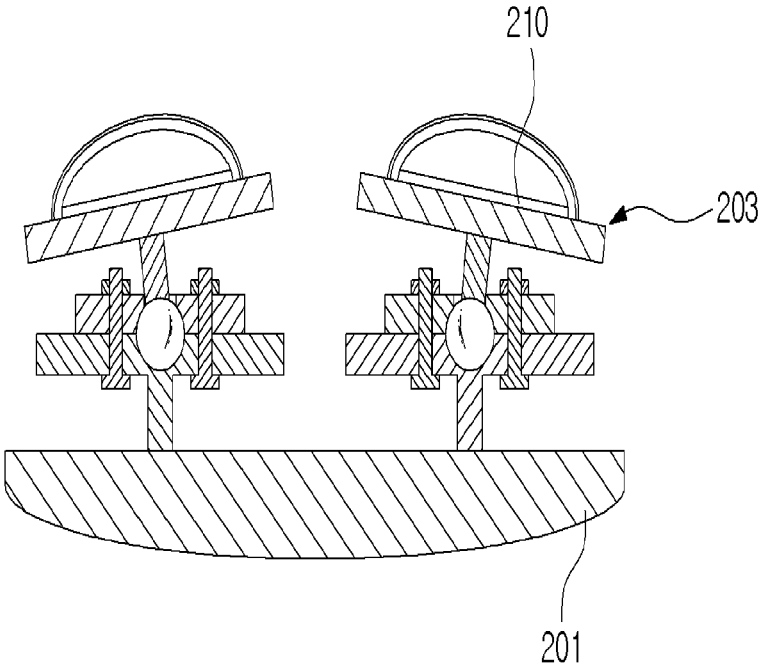

The footrest 203 is provided on the footrest support body 201 so as to be adjustable in inclination with respect to the left-right direction in a manner illustrated in FIGS. 7 through 11 and in FIGS. 12 and 13. The footrest 203 comprises a pair of footrests 203 which can respectively receive the feet of the user.

The foot support air cushion 210 is provided on the footrest 203 and is made of elastic material such as rubber. The foot support air cushion 210 is expanded by high pressure compressed air supplied thereinto so as to support the foot of the user.

Figure 8:
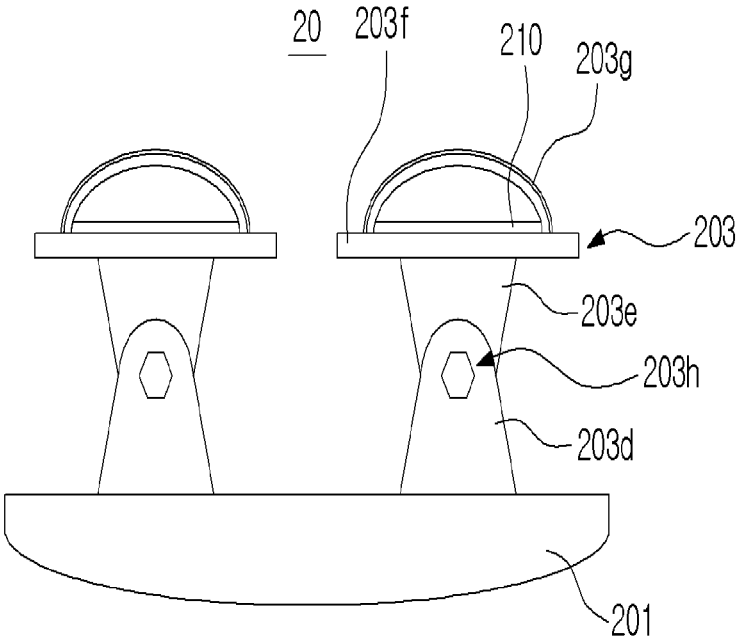
FIGS. 8 and 9 are front views of FIG. 7.
Figure 9:
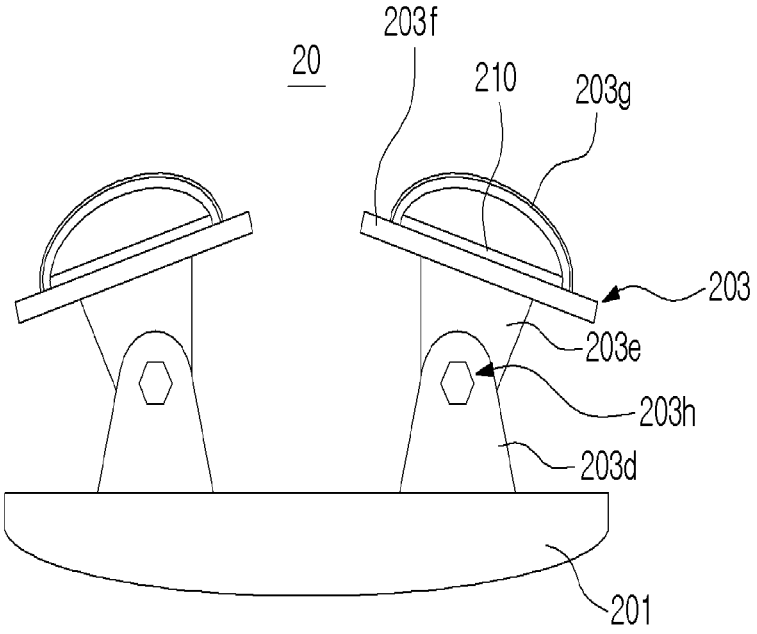

In more detail, as shown in FIGS. 8 and 9, each footrest 203 includes a vertical part 203*d*, a left-right rotatable part 203*e*, a bottom part 203*f*, a foot strap part 203*g* and a fastening unit 203*h*.

The vertical part 203*d* is provided on an upper surface of the footrest support body 201.

A lower end of the left-right rotatable part 203*e* is coupled to an upper end of the vertical part 203*d* by a shaft so that the position of an upper end of the left-right rotatable part 203*e* can be adjusted by rotating the left-right rotatable part 203*e* to the left or the right with respect to the vertical part 203*d* before the left-right rotatable part 203*e* is fixed in position to the vertical part 203*d*.

The bottom part 203*f* is horizontally provided on an upper end of the left-right rotatable part 203*e*.

The sole of the foot of the user is placed on the bottom part 203*f*.

The foot strap part 203*g* is integrally provided on the bottom part 203*f* to have a loop shape. The foot strap part 203*g* wraps over the top of the foot of the user.

The fastening unit 203*h* includes a bolt which couples the upper end of the vertical part 203*d* to the lower end of the left-right rotatable part 203*e*, and a nut which is tightened over the bolt to fix the left-right rotatable part 203*e* to the vertical part 203*d* after the position of the left-right rotatable part 203*e* with respect to the vertical part 203*d* has been determined.

The foot support air cushion 210 is provided both on an upper surface of the bottom part 203*f* and on a lower surface of the foot strap part 203*g*.

Alternatively, as shown in FIGS. 10 and 11, each footrest 203 may include a vertical part 203*d*, a left-right rotatable part 203*e*, a bottom part 203*f*, a foot strap part 203*g*, an angle adjustment plate 203*i* and a fastening unit 203*h*.

The foot support air cushion 210 is provided both on an upper surface of the bottom part 203*f* and on a lower surface of the foot strap part 203*g*.

The structures of the vertical part 203*d*, the left-right rotatable part 203*e*, the bottom part 203*f* and the foot strap part 203*g* have been already explained, therefore further explanation will be omitted.

The angle adjustment plate 203*i* is vertically provided on an upper end of the vertical part 203*d* and disposed ahead of the left-right rotatable part 203*e*.

Angle adjustment holes 203$i_1$ are formed in an upper portion of the angle adjustment plate 203*i* at position spaced apart from each other with respect to a circumferential direction at regular intervals.

The fastening unit 203*h* includes a bolt which passes both through one selected from among the angle adjustment holes 203$i_1$ and through the left-right rotatable part 203*e*; and a nut which is threadedly tightened over the bolt. The fastening unit 203*h* functions to fix the left-right rotatable part 203*e* in one place.

As a further alternative, as shown in FIGS. 12 and 13, each footrest 203 may include a vertical part 203*d*, a lower plate 203*j*, a rotary ball 203*k*, a vertical shaft 2031, an upper plate 203*m*, a bottom part 203*f*, a foot strap part 203*g* and a fastening unit 203*n*.

The foot support air cushion 210 is provided both on an upper surface of the bottom part 203*f* and on a lower surface of the foot strap part 203*g*.

The vertical part 203*d*, the bottom part 203*f* and the foot strap part 203*g* have the same structures as those of the above-described examples, therefore further explanation will be skipped.

The lower plate 203*j* is horizontally provided on an upper end of the vertical part 203*d*.

A receiving depression 203$j_1$ which is open at an upper end thereof and has a predetermined depth is formed in an upper surface of the lower plate 203*j*.

A lower part of the rotary ball 203*k* is received in the receiving depression 203$j_1$ of the lower plate 203*j* so as to be rotatable in front-rear and left-right directions.

The vertical shaft 2031 is vertically provided on an upper portion of the rotary ball 203*k*.

The upper plate 203*m* is horizontally provided on the lower plate 203*j*.

A receiving depression 203$m_1$ which is open at a lower end thereof and has a predetermined depth is formed in a lower surface of the upper plate 203*m*. An upper part of the rotary ball 203*k* is received in the receiving depression 203$m_1$ so as to be rotatable in front-rear and left-right directions.

A vertical hole 203$m_2$ the diameter of which is larger than the outer diameter of the vertical shaft 2031 is formed through an upper surface of the upper plate 203*m*.

The vertical shaft 2031 is disposed in the vertical hole 203$m_2$.

The fastening unit 203*n* includes bolts which are inserted into opposite side portions of the lower plate 203*j* and the upper plate 203*m*; and nuts which are threadedly tightened over the respective bolts.

Figure 14:
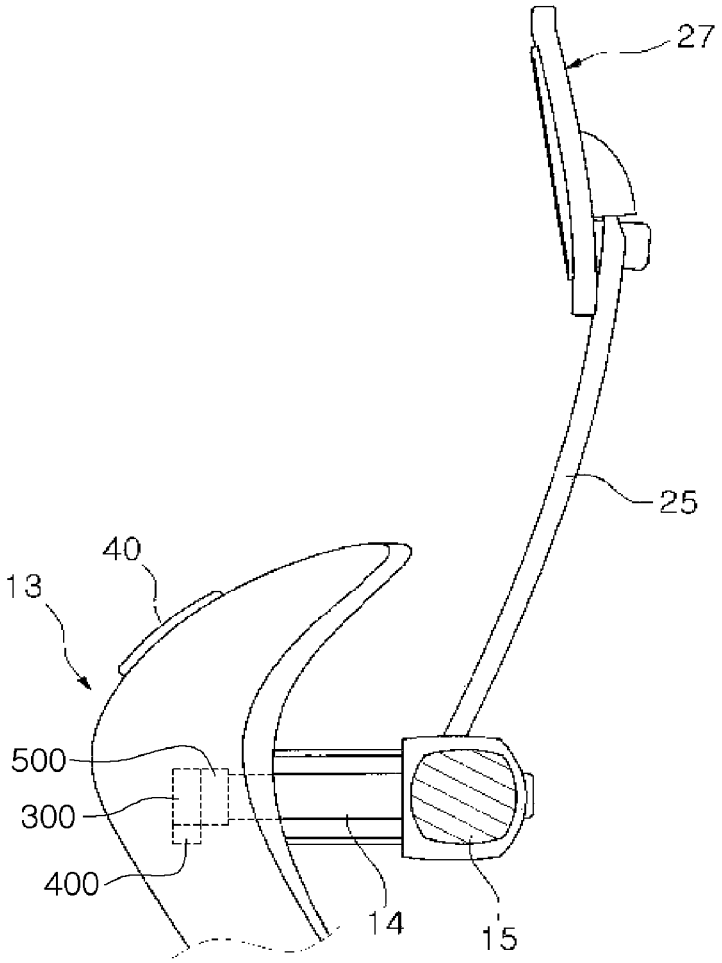
FIG. 14 is a sectional view taken along line II-II of FIG. 1 to illustrate a rotary magnetorheological fluid dampers.
Figure 15:
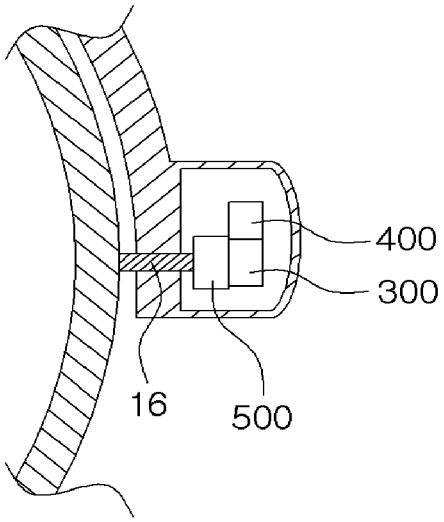
FIG. 15 is a sectional view taken along line III-III of FIG. 1 to illustrate the rotary magnetorheological fluid dampers.

As shown in FIGS. 14 and 15, the present invention further includes a drive motor 300 which transmits power to the first shaft 14 and the second shaft 16;

a clutch 400 which controls the power of the drive motor 300; and rotary magnetorheological fluid dampers 500 which are respectively provided on the first and second shafts 14 and 16 to apply damping force to the first and second shafts 14 and 16.

As the damping force, that is, the braking force, applied from the rotary magnetorheological fluid dampers 500 to the first and second shafts 14 and 16 is increased, force required for the user to rotate or reversely rotate the first and second shafts 14 and 16 is also increased.

As the damping force, that is, the braking force, applied from the rotary magnetorheological fluid dampers 500 to the first and second shafts 14 and 16 is reduced, force required for the user to rotate or reversely rotate the first and second shafts 14 and 16 is also reduced.

As shown in FIG. 2, the monitor 27 is configured such that it is rotated in conjunction with rotation of the roll motion frame 15. In detail, a monitor support 25 extends upwards from an outer surface of a medial portion of the roll motion frame 15. A monitor 27 is provided on an upper end of the monitor support 25. When the roll motion frame 15 rotates to the left or the right, the monitor 27 is rotated to the left or the right (refer to the arrows A and B of FIG. 1) in conjunction with the left-right rotation of the roll motion frame 15

Thanks to this construction, even when the user rotates his/her body to the left or the right, the monitor 27 is also rotated in response to the rotated posture. Therefore, the user can easily view exercise condition information displayed on the monitor 27. The exercise condition information includes information about a remedial exercise time and a posture rotation angle resulting from rotation of the user.

Meanwhile, the dynamic postural balance training system includes a control unit 30 and a manipulation unit 40 which transmits a manipulation signal to the control unit 30.

The control unit 30 includes a program related to typical dynamic postural balance training. Under the control of the control unit 30, the monitor 27 displays training information about the dynamic postural balance training along which the user performs an exercise. Thereby, the user can easily use the monitor 27 to monitor exercise conditions and the level of exercise while performing the remedial exercise. Moreover, because the monitor 27 according to the embodiment of the present invention can rotate in response to the left or right rotated posture of the user, the user can more conveniently see the monitor 27.

The manipulation unit 40 is provided in a front surface of an upper end of the support frame 13. Although any one of a variety of styles, such as a push button style, a dial button style, etc., can be used for the manipulation unit 40, in this embodiment of the present invention, a touch pad style is used.

As illustrated in Korean Patent Application No. 10-2010-0026527, which was filed by the applicant of the present invention, the roll motion frame 15 and the pitch motion frame 17 may be configured such that, when the user manipulates the manipulation unit 40, the roll motion frame 15 and the pitch motion frame 17 are automatically rotated in the front-rear and left-right directions by drive motors (not shown) provided on the respective shafts 14 and 16, or such that the roll motion frame 15 and the pitch motion frame 170 are manually rotated in the front-rear and left-right directions by the user.

A front-rear and left-right rotation angle of the roll motion frame 15 and the pitch motion frame 17 is displayed on the monitor 27. Information about such a front-rear and left-right rotation angle is also included in the exercise condition information. The user can easily use the monitor 27 to view the exercise condition information while performing the dynamic postural balance training.

Although the preferred embodiment of the present invention has been disclosed with reference to the drawings for illustrative purposes, the present invention is not limited to the construction and operation of the preferred embodiment. Those skilled in the art will appreciate that various modifications, additions and substitutions are possible, without departing from the scope and spirit of the invention as disclosed in the accompanying claims. These modifications, additions and substitutions must be regarded as falling within the bounds of the present invention.

INDUSTRIAL APPLICABILITY

As described above, in the present invention, a monitor can be rotated in response to rotation of the body of a user. Therefore, the user can more easily use the monitor to view his/her exercise conditions, whereby the exercise efficiency can be improved.

Furthermore, in the present invention, a foot support air cushion is used to fix the feet of the user in one place. Even after a long time has passed, the user can comfortably perform the remedial exercise. Moreover, because an outer surface of the foot support air cushion is made of soft memory foam material, the foot support air cushion can reliably wrap and support the foot of the user regardless of the size or shape of the foot. Therefore, the user can more comfortably carry out dynamic postural balance training.

In addition, a pelvis fixing air cushion is expanded by compressed air supplied thereinto and is changed in shape corresponding to the pelvis of the user so that it can be brought into close contact with the pelvis of the user. Therefore, the pelvis of the user can be comfortably supported by the pelvis fixing air cushion regardless of the size and shape of the pelvis of the user, whereby the efficiency of the remedial exercise can be enhanced.

The invention claimed is:

1. A dynamic postural balance training system, comprising:

a base frame;

a support frame extending upwards from the base frame;

a roll motion frame coupled to an upper end of the support frame by a first shaft so as to be rotatable in a left-right direction, wherein a front end of the first shaft is fastened to a rear surface of the upper end of the support frame by a bearing and a rear end of the first shaft is fixed to a medial portion of the roll motion frame;

a pitch motion frame coupled to the roll motion frame by a second shaft so as to be rotatable in a front-rear direction;

a pelvis fastening unit provided inside the pitch motion frame, the pelvis fastening unit being expanded in volume to support a pelvis of a user;

a connector extending downwards from the pitch motion frame; and a foot fastening unit coupled to a lower end of the connector, the foot fastening unit being expanded in volume to support feet of the user.

2. The dynamic postural balance training system of claim 1, wherein the connector comprises:

a support pipe coupled to a lower portion of each of opposite ends of the pitch motion frame;

a movable pipe slidably disposed in the support pipe, with a plurality length adjustment holes formed in an outer surface of the movable pipe at positions spaced apart from each other in a longitudinal direction of the movable pipe; and a bolt inserted into a lower portion of the support pipe and coupled to one of the length adjustment holes, whereby a height of the foot fastening unit can be adjusted.

3. The dynamic postural balance training system of claim 1, wherein the pelvis fastening unit comprises:

a pelvis fixing air cushion provided on a circumferential inner surface of each of front and rear parts of the pitch motion frame, the pelvis fixing air cushion being expanded in volume by compressed air supplied thereinto; and an air supply hose connected to the pelvis fixing air cushion so that compressed air is transmitted from a compressor into the pelvis fixing air cushion through the air supply hose, wherein a memory foam made of latex is provided on a circumferential outer surface of the pelvis fixing air cushion, the memory foam being brought into close contact with the pelvis of the user when the pelvis fixing air cushion is expanded.

4. The dynamic postural balance training system of claim 1, wherein the foot fastening unit comprises:

a footrest support body coupled to the lower end of the connector, the footrest support body having a planar shape;

a footrest provided on an upper surface of the footrest support body, the footrest comprising a pair of footrests configured to receive the feet of the user; and a foot support air cushion provided on an inner surface of each of the footrests, the foot support air cushion being expanded in volume by compressed air supplied thereinto, thus configured to support the corresponding foot of the user.

5. The dynamic postural balance training system of claim 4, wherein each of the pair of footrests comprises:

a bottom part installed on the footrest support body so that a sole of the corresponding foot of the user may be placed on the bottom part;

a heel support part extending upwards from a rear end of the bottom part; and a foot strap part extending upwards from a front end of the bottom part, the foot strap part having a loop shape configured to wrap a top of the foot of the user, and the foot support air cushion comprises:

a first foot support air cushion provided on an inner surface of each of the bottom part and the heel support part; and a second foot support air cushion provided on an inner surface of the foot strap part, and wherein a memory foam is provided on each of the first and second foot support air cushions, the memory foam being made of latex material.

6. The dynamic postural balance training system of claim 1, wherein the foot fastening unit comprises:

a footrest support body coupled to the lower end of the connector, the footrest support body having a planar shape;

a footrest provided on an upper surface of the footrest support body so as to be adjustable in an inclination angle with respect to a left-right direction or a front-rear direction, the footrest comprising a pair of footrests configured to receive the feet of the user; and a foot support air cushion provided on each of the footrests, the foot support air cushion being expanded in volume by compressed air supplied thereinto, thus configured to support the corresponding foot of the user.

7. The dynamic postural balance training system of claim 6, wherein each of the pair of footrests comprises:

a vertical part provided on an upper surface of the footrest support body;

a left-right rotatable part coupled at a lower end thereof to an upper end of the vertical part by a shaft so that a position of an upper end of the left-right rotatable part can be fixed after being adjusted with respect to the left-right direction;

a bottom part horizontally provided on an upper end of the left-right rotatable part so that a sole of the corresponding foot of the user may be placed on the bottom part;

a foot strap part provided on the bottom part, the foot strap part configured to wrap a top of the foot of the user; and a fastening unit coupling the upper end of the vertical part to the lower end of the left-right rotatable part by a shaft, the fastening unit fixing the position of the left-right rotatable part that has been adjusted in position with respect to the left-right direction, wherein the foot support air cushion is provided on each of an upper surface of the bottom part and a lower surface of the foot strap part.

8. The dynamic postural balance training system of claim 6, wherein each of the footrests comprises:

a vertical part provided on an upper surface of the footrest support body;

a left-right rotatable part coupled at a lower end thereof to an upper end of the vertical part by a shaft so that a position of an upper end of the left-right rotatable part can be fixed after being adjusted with respect to the left-right direction;

a bottom part horizontally provided on an upper end of the left-right rotatable part so that a sole of the corresponding foot of the user may be placed on the bottom part;

a foot strap part provided on the bottom part, the foot strap part configured to wrap over a top of the foot of the user;

an angle adjustment plate vertically provided on the upper end of the vertical part and disposed ahead of the left-right rotatable part, with a plurality of angle adjustment holes formed in an upper portion of the angle adjustment plate at positions spaced apart from each other with respect to a circumferential direction at regular intervals; and a fastening unit inserted both into one selected from among the angle adjustment holes of the angle adjustment plate and into the left-right rotatable part so that a position of the left-right rotatable part is fixed, wherein the foot support air cushion is provided on each of an upper surface of the bottom part and a lower surface of the foot strap part.

9. The dynamic postural balance training system of claim 6, wherein each of the footrests comprises:

a vertical part provided on an upper surface of the footrest support body;

a lower plate horizontally provided on an upper end of the vertical part, with a first receiving depression formed in an upper surface of the lower plate, the first receiving depression having a predetermined depth and being open at an upper end thereof;

a rotary ball disposed at a lower portion thereof in the first receiving depression of the lower plate so as to be rotatable in front-rear and left-right directions;

a vertical shaft provided on an upper portion of the rotary ball;

an upper plate horizontally provided on the lower plate, with a second receiving depression formed in a lower surface of the upper plate, the second receiving depression having a predetermined depth and being open at a lower end thereof, so that an upper portion of the rotary ball is rotatably received in the second receiving depression of the upper plate, the upper plate having a vertical hole in an upper surface thereof, the vertical hole being open at upper and lower ends thereof so that the vertical shaft is disposed in the vertical hole;

a bottom part provided on an upper end of the vertical shaft so that a sole of the corresponding foot of the user may be placed on the bottom part;

a foot strap part provided on the bottom part, the foot strap part configured to wrap a top of the foot of the user; and a pair of fastening units vertically threadedly coupled into opposite side portions of the lower plate and the upper plate, wherein the foot support air cushion is provided on each of an upper surface of the bottom part and a lower surface of the foot strap part.

10. The dynamic postural balance training system of claim 1, further comprising:

a drive motor transmitting power both to the first shaft and the second shaft;

a clutch controlling the power of the drive motor; and rotary magnetorheological fluid dampers respectively provided on the first and second shafts to apply damping force to the first and second shafts.

11. The dynamic postural balance training system of claim 1, further comprising a monitor provided on an upper end of a monitor support extending upwards from the medial portion of the roll motion frame, the monitor being rotated in conjunction with the roll motion frame.

* * * * *